US012565624B2

(12) United States Patent
Watanabe

(10) Patent No.: US 12,565,624 B2
(45) Date of Patent: Mar. 3, 2026

(54) GREASE COMPOSITION

(71) Applicant: IDEMITSU KOSAN CO., LTD., Tokyo (JP)

(72) Inventor: Go Watanabe, Chiyoda-ku (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/574,588

(22) PCT Filed: Jun. 29, 2022

(86) PCT No.: PCT/JP2022/025861
§ 371 (c)(1),
(2) Date: Dec. 27, 2023

(87) PCT Pub. No.: WO2023/277044
PCT Pub. Date: Jan. 5, 2023

(65) Prior Publication Data

US 2024/0318092 A1 Sep. 26, 2024

(30) Foreign Application Priority Data

Jun. 30, 2021 (JP) ..... 2021-109746

(51) Int. Cl.
*C10M 115/08* (2006.01)
*C10M 169/02* (2006.01)
(Continued)

(52) U.S. Cl.
CPC ..... *C10M 115/08* (2013.01); *C10M 169/02* (2013.01); *C10M 169/06* (2013.01);
(Continued)

(58) Field of Classification Search
CPC ..... C10M 115/08; C10M 169/02; C10M 169/06; C10M 2215/1026;
(Continued)

(56) References Cited

U.S. PATENT DOCUMENTS 5,498,357 A * 3/1996 Naka ..... C10M 125/22 508/176
2014/0205226 A1 7/2014 Sonoda et al.
(Continued)

FOREIGN PATENT DOCUMENTS

CN 104327917 A 2/2015
EP 3 178 910 A1 6/2017
(Continued)

OTHER PUBLICATIONS

International Search Report issued Aug. 2, 2022 in PCT/JP2022/025861 (with English translation), 5 pages.
(Continued)

*Primary Examiner* — Cephia D Toomer
(74) *Attorney, Agent, or Firm* — Oblon, McClelland, Maier & Neustadt, L.L.P.

(57) ABSTRACT

Provided is a grease composition containing a base oil (A), a urea-based thickener (B), and a hardening agent for fat and/or fatty oil (C), in which particles containing the urea-based thickener (B) in the grease composition satisfy the following requirement (I), liquefy when heated to a certain temperature or higher, return to a solid state when returned to ordinary temperature after heated to a certain temperature or higher, have high responsiveness to application of shear stress, and are easily softened when shear stress is applied.

Requirement (I): an arithmetic average particle diameter of the particles on an area basis as measured by a laser diffraction and scattering method is 2.0 μm or less.

17 Claims, 5 Drawing Sheets

(51) Int. Cl.

| | |
|---|---|
| ***C10M 169/06*** | (2006.01) |
| *C10N 20/00* | (2006.01) |
| *C10N 20/02* | (2006.01) |
| *C10N 20/06* | (2006.01) |

(52) U.S. Cl.
CPC ..... *C10M 2215/1026* (2013.01); *C10N 2020/019* (2020.05); *C10N 2020/02* (2013.01); *C10N 2020/06* (2013.01)

(58) Field of Classification Search
CPC .... C10M 2203/1025; C10M 2203/108; C10M 2207/283; C10N 2020/019; C10N 2020/02; C10N 2020/06; C10N 2020/011; C10N 2030/00; C10N 2030/06; C10N 2040/04; C10N 2050/10
See application file for complete search history.

(56) References Cited

U.S. PATENT DOCUMENTS

| | | | | |
|---|---|---|---|---|
| 2016/0160923 | A1* | 6/2016 | Kawamura | C10M 105/04 384/462 |
| 2018/0037842 | A1* | 2/2018 | Suetsugu | B01J 19/1806 |
| 2019/0169522 | A1 | 6/2019 | Sawaguchi et al. | |
| 2022/0145203 | A1 | 5/2022 | Watanabe | |
| 2022/0162513 | A1 | 5/2022 | Shishikura | |

FOREIGN PATENT DOCUMENTS

| | | | |
|---|---|---|---|
| EP | 3936590 | | 1/2022 |
| JP | 2005-54008 | A | 3/2005 |
| JP | 2010-209129 | A | 9/2010 |
| JP | 2016-37554 | A | 3/2016 |
| JP | 2017-36363 | A | 2/2017 |
| WO | WO 2010/079743 | | 7/2010 |
| WO | WO 2018/030090 | A1 | 2/2018 |
| WO | WO 2020/179589 | A1 | 9/2020 |
| WO | WO 2020/179603 | A1 | 9/2020 |

OTHER PUBLICATIONS

Written Opinion of the International Search Authority issued Aug. 2, 2022 in PCT/JP2022/025861 (with English translation), 10 pages.
Official communication issued on May 15, 2025, corresponding EP Application No. 22833190.6.
Official communication issued on Nov. 11, 2025, in corresponding JP application 2023-532001 (with English translation provided by Global Dossier).

* cited by examiner

GREASE COMPOSITION

CROSS-REFERENCE TO RELATED APPLICATIONS

The present application is a 35 U.S.C. § 371 national stage patent application of International patent application PCT/JP2022/025861, filed on Jun. 29, 2022, which is based on and claims the benefits of priority to Japanese Application No. 2021-109746, filed on Jun. 30, 2021. The entire contents of these applications are incorporated herein by reference.

TECHNICAL FIELD

The present invention relates to a grease composition.

BACKGROUND ART

A grease composition is easily sealed as compared with a lubricating oil, and can reduce the size and weight of a machine to which the grease composition is applied. Therefore, the grease composition has been widely used for lubricating various sliding parts of automobiles, electrical equipment, industrial machines, and the like.

In addition, due to increased awareness of energy conservation in recent years, grease compositions are also required to have low torque properties. For example, PTL 1 proposes a grease composition containing a base oil, a thickener, and an amino acid-based gelling agent as a grease composition having low torque properties. Further, PTL 2 proposes a grease composition containing a saturated fatty acid triglyceride as a base oil and a glycerol fatty acid ester as a thickener as a grease composition having low torque properties.

CITATION LIST

Patent Literature

PTL 1: JP 2010-209129 A
PTL 2: JP 2017-036363 A

SUMMARY OF INVENTION

Technical Problem

By the way, for example, the filling of the grease composition into a unit type device such as a reduction gear, a servo motor, a controller, or a torch in a factory robot is mainly performed by drum pumping in which the grease composition put in a drum can is filled via a hose using a pump.

However, since the drum pumping is a method of supplying and filling the grease composition in its characteristic solid state, when the grease composition is injected into a unit type device, it is difficult for the grease composition to spread to gaps and corners of the device. In addition, in order to inject an appropriate amount of the grease composition without causing a shortage of the filling amount of the grease composition, it is necessary to supply an excessive amount of the grease composition than the amount to be actually filled, which is wasteful.

Therefore, the present inventor has conducted intensive studies in order to solve the above-described problems, and has come to the following idea.

That is, the present inventor has come to the idea that by heating a solid grease composition to a certain temperature or higher to liquefy it, immersing the device in the liquefied grease composition, taking it out, returning it to ordinary temperature, and returning the grease composition to a solid state, an appropriate amount of the solid grease composition can be filled into the device without waste while the solid grease composition spreads through the gaps of the device.

Therefore, in order to realize the above idea, the present inventor has focused on a grease composition containing a hardening agent for fat and/or fatty oil as in PTLs 1 and 2, and has conducted intensive studies. However, it has been found that a grease composition containing a hardening agent for fat and/or fatty oil has insufficient responsiveness to the application of shear stress and is less likely to be softened when shear stress is applied. As described above, in recent years, awareness of energy saving has increased. Therefore, the grease composition is also required to have high responsiveness to application of shear stress and to be easily softened when shear stress is applied.

Therefore, an object of the present invention is to provide a grease composition that liquefies when heated to a certain temperature or higher, returns to a solid state when returned to ordinary temperature after being heated to a certain temperature or higher, has high responsiveness to the application of shear stress, and is easily softened when shear stress is applied.

Solution to Problem

As a result of intensive studies to solve the above-mentioned problems, the present inventor has come up with the idea of using a hardening agent for fatty oil and a urea-based thickener in combination. Further, the present inventor has focused on the particle diameter of particles containing the urea-based thickener, and has conducted intensive studies. As a result, it has been found that the arithmetic average particle diameter on an area basis when the particles are measured by a laser diffraction and scattering method is adjusted to a predetermined range, and a grease composition containing a hardening agent for fat and/or fatty oil can solve the above-mentioned problems, thereby completing the present invention.

That is, the present invention provides the following [1].

[1] A grease composition containing a base oil (A), a urea-based thickener (B), and a hardening agent for fat and/or fatty oil (C), in which particles containing the urea-based thickener (B) in the grease composition satisfy the following requirement (I):

Requirement (I): an arithmetic average particle diameter of the particles on an area basis as measured by a laser diffraction and scattering method is 2.0 μm or less.

Advantageous Effects of Invention

According to the present invention, it is possible to provide a grease composition that liquefies when heated to a certain temperature or higher, returns to a solid state when returned to ordinary temperature after being heated to a certain temperature or higher, has high responsiveness to the application of shear stress, and is easily softened when shear stress is applied.

DESCRIPTION OF EMBODIMENTS

Figure 1:
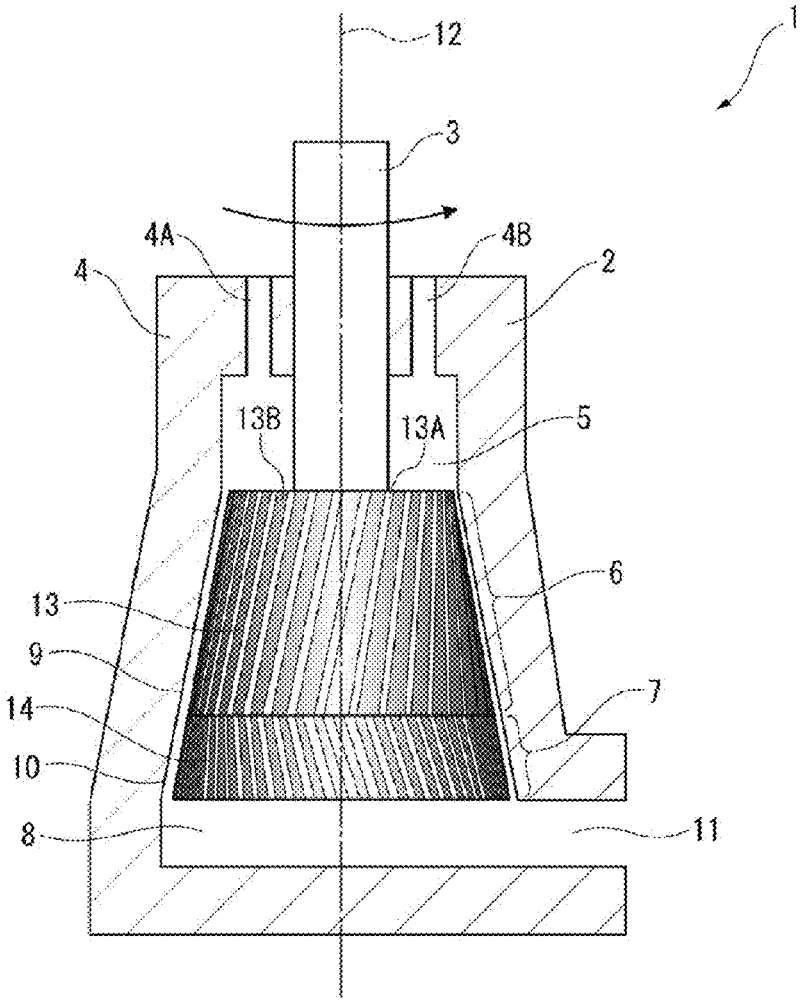
FIG. 1 is a schematic cross-sectional view of a grease production apparatus which can be used in one embodiment of the present invention.

In the description herein, a lower limit value and an upper limit value stepwise described for a preferred numerical range (for example, a range of content) can be individually independently combined. For example, regarding an expression of "preferably 10 to 90, and more preferably 30 to 60", by combining the "preferred lower limit value (10)" and the "more preferred upper limit value (60)", a suitable range can also be conceived as "10 to 60".

Also in the description herein, the numerical value in Examples is a numerical value usable as an upper limit value or a lower limit value.

In the present invention, the ordinary temperature means 20° C. to 30° C.

In the present invention, the room temperature means 25° C.

In addition, in the present invention, heating means heating to a temperature higher than ordinary temperature, and in particular, means heating to 60° C. to 80° C.

[Grease Composition]

The grease composition of the present invention is a grease composition containing a base oil (A), a urea-based thickener (B), and a hardening agent for fat and/or fatty oil (C), in which particles containing the urea-based thickener (B) in the grease composition satisfy the following requirement (I).

Requirement (I): an arithmetic average particle diameter of the particles on an area basis as measured by a laser diffraction and scattering method is 2.0 μm or less.

In the following description, the "base oil (A)", the "urea-based thickener (B)", and the "hardening agent for fat and/or fatty oil (C)" are also referred to as a "component (A)", a "component (B)", and a "component (C)", respectively.

In the grease composition according to one embodiment of the present invention, a total content of the component (A), the component (B), and the component (C) is preferably 60% by mass or more, more preferably 70% by mass or more, still more preferably 80% by mass or more, and yet still more preferably 90% by mass or more, based on the total amount (100% by mass) of the grease composition. On the other hand, the total content is usually 100% by mass or less, preferably less than 100% by mass, more preferably 99% by mass or less, and still more preferably 98% by mass or less.

The grease composition according to one embodiment of the present invention may contain components other than the component (A), the component (B), and the component (C) as long as the effects of the present invention are not impaired.

<Requirement (I)>

In the grease composition of the present invention, the particles containing the urea-based thickener (B) in the grease composition satisfy the following requirement (I).

Requirement (I): an arithmetic average particle diameter of the particles on an area basis as measured by a laser diffraction and scattering method is 2.0 μm or less.

By satisfying the above requirement (I), a grease composition that softens when a shear stress is applied is obtained.

The requirement (I) can also be said to be a parameter expressing a state of aggregation of the urea-based thickener (B) in the grease composition.

Here, the term "particles containing the urea-based thickener (B)" as a measurement target by the laser diffraction and scattering method refers to particles in which the urea-based thickener (B) contained in the grease composition aggregates.

In a case in which an additive other than the urea-based thickener (B) is contained in the grease composition, the particle diameter prescribed in the requirement (I) can be obtained through measurement by the laser diffraction and scattering method for a grease composition prepared under the same conditions without being blended with the additive. However, in a case in which the additive is liquid at room temperature (25° C.), or in a case in which the additive is dissolved in the base oil (A), it does not matter if a grease composition containing the additive blended therein is the measurement target.

The urea-based thickener (B) is usually obtained by reacting an isocyanate compound with a monoamine, but since the reaction rate is very high, the urea-based thickener (B) is aggregated, and large particles (micelle particles, so-called "lumps") are likely to be excessively generated. As a result of intensive studies, the present inventor has found that when the particle diameter prescribed in the requirement (I) exceeds 2.0 μm, the grease composition has insufficient responsiveness to shear stress and is less likely to be softened even when shear stress is applied.

On the other hand, it has been found that when the particle diameter prescribed in the requirement (I) is micronized to 2.0 μm or less, a grease composition having high responsiveness to shear stress and being easily softened when shear stress is applied can be obtained.

It is presumed that this effect is due to the fact that by micronizing the particle diameter prescribed in the above requirement (I) to 2.0 μm or less, the grease itself is constituted by fine bundles having a narrow distribution of thickness and length, and therefore, the grease is likely to change into liquid properties with a small strain. In addition, by micronizing the particle diameter prescribed in the requirement (I) to 2.0 μm or less, the holding power of the base oil (A) by the particles is improved. Therefore, it is presumed that the action of allowing the base oil (A) to spread well and the action of allowing the hardening agent for fat and/or fatty oil (C) to spread well to a lubricating site are improved.

From the viewpoint, in the grease composition according to one embodiment of the present invention, the particle diameter prescribed in the requirement (I) is preferably 1.5 μm or less, more preferably 1.0 μm or less, still more preferably 0.9 μm or less, yet still more preferably 0.8 μm or less, even still more preferably 0.7 μm or less, further more preferably 0.6 μm or less, yet further more preferably 0.5 μm or less, and even further more preferably 0.4 μm or less. In addition, the particle diameter is typically 0.01 μm or more.

<Requirement (II)>

Here, it is preferable that the grease composition according to one embodiment of the present invention further satisfies the following requirement (II).

Requirement (II): a specific surface area of the particles as measured by the laser diffraction and scattering method is $0.5\times10^5$ $cm^2/cm^3$ or more.

The specific surface area prescribed in the above requirement (II) is a secondary index that indicates the state of micronization of the particles containing the urea-based thickener (B) in the grease composition and the presence of large particles (lumps). That is, by satisfying the requirement (I) and further satisfying the requirement (II), the state of micronization of the particles containing the urea-based thickener (B) in the grease composition is more favorable, and the presence of large particles (lumps) is further suppressed. Therefore, it is possible to obtain a grease composition which has higher responsiveness to shear stress and is more easily softened when shear stress is applied.

From the viewpoint, the specific surface area prescribed in the requirement (II) is preferably $0.7\times10^5$ $cm^2/cm^3$ or more, more preferably $0.8\times10^5$ $cm^2/cm^3$ or more, still more preferably $1.2\times10^5$ $cm^2/cm^3$ or more, yet still more preferably $1.5\times10^5$ $cm^2/cm^3$ or more, even still more preferably $1.8\times10^5$ $cm^2/cm^3$ or more, and further more preferably $2.0\times10^5$ $cm^2/cm^3$ or more. The specific surface area is typically $1.0\times10^6$ $cm^2/cm^3$ or less.

In the description herein, the values prescribed in the requirement (I) and further the requirement (II) are values measured by methods described in Examples to be described later.

In addition, the values prescribed in the requirement (I) and further the requirement (II) are able to be adjusted by chiefly adjusting production conditions of the urea-based thickener (B).

The respective components contained in the grease composition according to the present invention are hereunder described in detail while paying attention to specific means for satisfying the requirement (I) and further the requirement (II).

<Base Oil (A)>

As the base oil (A) contained in the grease composition of the present invention, base oils conventionally used as lubricating oil base oils can be used without particular limitation, and examples thereof include one or more selected from mineral oils and synthetic oils.

Examples of the mineral oil include distillate oils obtained by subjecting a paraffin crude oil, an intermediate base crude oil, or a naphthenic crude oil to atmospheric distillation or vacuum distillation, and refined oils obtained by refining these distillate oils in accordance with a conventional method.

Examples of the purification method include a solvent dewaxing treatment, a hydroisomerization treatment, a hydrofinishing treatment, and a clay treatment.

The mineral oil may be used alone or may be used in combination of two or more thereof.

As the mineral oil, for example, a base oil belonging to Group II or Group III in the American Petroleum Institute (API) base oil category can be used.

In addition, gas-to-liquids (GTL) base oils obtained by isomerizing a wax produced from a natural gas by a Fischer-Tropsch process or the like are also suitably used.

As the mineral oil, for example, bright stock can be used.

The bright stock refers to a high-viscosity base oil produced by subjecting a vacuum distillation residue oil of a crude oil to a treatment selected from solvent deasphaltation, solvent extraction, solvent dewaxing, hydrorefining, and the like. The crude oil for producing the bright stock is not particularly limited, and examples thereof include a paraffinic crude oil and a naphthenic crude oil.

In the grease composition according to one embodiment of the present invention, a content of the mineral oil is preferably 60% by mass or more, more preferably 70% by mass or more, still more preferably 80% by mass or more, and yet still more preferably 90% by mass or more, based on the total amount (100% by mass) of the base oil (A). On the other hand, the content is usually 100% by mass or less, preferably less than 100% by mass, more preferably 99% by mass or less, and still more preferably 98% by mass or less.

Examples of the synthetic oil include a hydrocarbon-based oil, an aromatic oil, an ester-based oil, an ether-based oil, and a synthetic oil obtained by isomerizing a wax (GTL wax) produced by a Fischer-Tropsch method or the like.

The synthetic oil may be used alone or may be used in combination of two or more thereof.

Examples of the hydrocarbon-based oil include poly-α-olefin (PAO) such as normal paraffin, isoparaffin, polybutene, polyisobutylene, 1-decene oligomer, 1-decene and ethylene co-oligomer, and hydrides thereof.

Examples of the aromatic oil include alkylbenzenes such as monoalkylbenzene and dialkylbenzene; and alkylnaphthalenes such as monoalkylnaphthalene, dialkylnaphthalene, and polyalkylnaphthalene.

Examples of the ester-based oil include diester-based oils such as dibutyl sebacate, di-2-ethylhexyl sebacate, dioctyl adipate, diisodecyl adipate, ditridecyl adipate, ditridecyl glutarate, and methyl acetyl ricinolate; aromatic ester-based oils such as trioctyl trimellitate, tridecyl trimellitate, and tetraoctyl pyromellitate; polyol ester-based oils such as trimethylolpropane caprylate, trimethylolpropane berargonate, pentaerythritol 2-ethylhexanoate, and pentaerythritol berargonate; and complex ester-based oils such as oligoesters of polyhydric alcohols and mixed fatty acids of dibasic acids and monobasic acids.

Examples of the ether-based oil include polyglycols such as polyethylene glycol, polypropylene glycol, polyethylene glycol monoether, and polypropylene glycol monoether; and phenyl ether-based oils such as monoalkyl triphenyl ether, alkyl diphenyl ether, dialkyl diphenyl ether, pentaphenyl ether, tetraphenyl ether, monoalkyl tetraphenyl ether, and dialkyl tetraphenyl ether.

The base oil (A) of the present embodiment preferably has a kinematic viscosity at 40° C. of 10 $mm^2/s$ or more, more preferably 25 $mm^2/s$ or more, and still more preferably 40 $mm^2/s$ or more. When the kinematic viscosity at 40° C. of the base oil (A) is 40 $mm^2/s$ or more, the effects of the present invention are more easily exhibited.

On the other hand, the base oil (A) of the present embodiment preferably has a kinematic viscosity at 40° C. of 415 $mm^2/s$ or less, more preferably 300 $mm^2/s$ or less, still more preferably 200 $mm^2/s$ or less, yet still more preferably 100 $mm^2/s$ or less, and even still more preferably 80 $mm^2/s$ or less. When the kinematic viscosity at 40° C. of the base oil (A) is 80 $mm^2/s$ or less, the effects of the present invention are more easily exhibited.

The upper limit values and the lower limit values of these numerical ranges can be arbitrarily combined. Specifically, it is preferably 10 to 300 $mm^2/s$, more preferably 25 to 200 $mm^2/s$, and still more preferably 40 to 100 $mm^2/s$.

The base oil (A) used in one embodiment of the present invention may be a mixed base oil adjusted by combining a high-viscosity base oil and a low-viscosity base oil so as to have a kinematic viscosity in the above range.

The base oil (A) of the present embodiment has a kinematic viscosity at 100° C. of preferably 1.0 to 50.0 $mm^2/s$, and more preferably 5.0 to 20.0 $mm^2/s$, from the viewpoint of more easily exhibiting the effects of the present invention.

The viscosity index of the base oil (A) used in one embodiment of the present invention is preferably 90 or more, more preferably 110 or more, and still more preferably 130 or more.

In the description herein, the kinematic viscosity and the viscosity index each mean a value measured or calculated in accordance with JIS K 2283:2000.

In the grease composition according to one embodiment of the present invention, a content of the base oil (A) is preferably 50% by mass or more, more preferably 55% by mass or more, still more preferably 60% by mass or more, and yet still more preferably 62% by mass or more, and is preferably 98.5% by mass or less, more preferably 97% by mass or less, still more preferably 95% by mass or less, yet still more preferably 93% by mass or less, even still more preferably 92% by mass or less, further more preferably 90% by mass or less, and still further more preferably 85% by mass or less, based on the total amount (100% by mass) of the grease composition.

<Urea-Based Thickener (B)>

It is sufficient that the urea-based thickener (B) contained in the grease composition of the present invention is a compound having a urea bond, and a diurea compound having two urea bonds is preferred, and a diurea compound represented by the following general formula (b1) is more preferred.

$$R^1—NHCONH—R^3—NHCONH—R^2 \quad (b1)$$

The urea-based thickener (B) used in one embodiment of the present invention may be one type or a mixture of two or more types.

In the general formula (b1), $R^1$ and $R^2$ each independently represent a monovalent hydrocarbon group having 6 to 24 carbon atoms. $R^1$ and $R^2$ may be identical to each other, or may be different from each other. $R^3$ represents a divalent aromatic hydrocarbon group having 6 to 18 carbon atoms.

The number of carbon atoms in the monovalent hydrocarbon group which can be selected as $R^1$ and $R^2$ in the general formula (b1) is 6 to 24, preferably 6 to 20, and more preferably 6 to 18.

Examples of the monovalent hydrocarbon group which can be selected as $R^1$ and $R^2$ include a saturated or unsaturated monovalent chain hydrocarbon group, a saturated or unsaturated monovalent alicyclic hydrocarbon group, and a monovalent aromatic hydrocarbon group.

Here, in $R^1$ and $R^2$ in the general formula (b1), when a content rate of the chain hydrocarbon group is designated as an X molar equivalent, a content rate of the alicyclic hydrocarbon group is designated as a Y molar equivalent, and a content rate of the aromatic hydrocarbon group is designated as a Z molar equivalent, it is preferred that the following requirements (a) and (b) are satisfied.

Requirement (a): a value of $\{[(X+Y)/(X+Y+Z)]\times 100\}$ is 90 or more (preferably 95 or more, more preferably 98 or more, and still more preferably 100).

Requirement (b): an X/Y ratio is 0/100 (X=0, Y=100) to 100/0 (X=100, Y=0) (preferably 10/90 to 90/10, more preferably 20/80 to 80/20, and still more preferably 40/60 to 80/20).

Since the alicyclic hydrocarbon group, the chain hydrocarbon group, and the aromatic hydrocarbon group are groups selected as $R^1$ and $R^2$ in the general formula (b1), the total sum of the values of X, Y, and Z is 2 molar equivalents with respect to 1 mol of the compound represented by the general formula (b1). Further, the values of the above requirements (a) and (b) mean average values with respect to the total amount of the compounds represented by the above general formula (b1) contained in the grease composition.

By using the compound represented by the general formula (b1) that satisfies the requirements (a) and (b), a grease composition having excellent low-temperature characteristics is easily obtained.

The values of X, Y, and Z can be calculated from the molar equivalent of each amine used as a raw material.

Examples of the monovalent saturated chain hydrocarbon group include a linear or branched alkyl group having 6 to 24 carbon atoms, and specific examples thereof include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an octadecenyl group, a nonadecyl group, and an icosyl group.

Examples of the monovalent unsaturated chain hydrocarbon group include a linear or branched alkenyl group having 6 to 24 carbon atoms, and specific examples thereof include a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an icosenyl group, an oleyl group, a geranyl group, a farnesyl group, and a linoleyl group.

The monovalent saturated chain hydrocarbon group and the monovalent unsaturated chain hydrocarbon group each may be a linear chain or a branched chain.

Examples of the monovalent saturated alicyclic hydrocarbon group include a cycloalkyl group, such as a cyclohexyl group, a cycloheptyl group, a cyclooctyl group, and a cyclononyl group; and a cycloalkyl group substituted with an alkyl group having 1 to 6 carbon atoms (preferably a cyclohexyl group substituted with an alkyl group having 1 to 6 carbon atoms), such as a methylcyclohexyl group, a dimethylcyclohexyl group, an ethylcyclohexyl group, a diethylcyclohexyl group, a propylcyclohexyl group, an isopropylcyclohexyl group, a 1-methyl-propylcyclohexyl group, a butylcyclohexyl group, a pentylcyclohexyl group, a pentyl-methylcyclohexyl group, and a hexylcyclohexyl group.

Examples of the monovalent unsaturated alicyclic hydrocarbon group include a cycloalkenyl group, such as a cyclohexenyl group, a cycloheptenyl group, and a cyclooctenyl group; and a cycloalkenyl group substituted with an alkyl group having 1 to 6 carbon atoms (preferably a cyclohexenyl group substituted with an alkyl group having 1 to 6 carbon atoms), such as a methylcyclohexenyl group, a dimethylcyclohexenyl group, an ethylcyclohexenyl group, a diethylcyclohexenyl group, and a propylcyclohexenyl group.

Examples of the monovalent aromatic hydrocarbon group include a phenyl group, a biphenyl group, a terphenyl group, a naphthyl group, a diphenylmethyl group, a diphenylethyl group, a diphenylpropyl group, a methylphenyl group, a dimethylphenyl group, an ethylphenyl group, and a propylphenyl group.

The number of carbon atoms in the divalent aromatic hydrocarbon group which can be selected as $R^3$ in the general formula (b1) is 6 to 18, preferably 6 to 15, and more preferably 6 to 13.

Examples of the divalent aromatic hydrocarbon group which can be selected as $R^3$ include a phenylene group, a diphenylmethylene group, a diphenylethylene group, a diphenylpropylene group, a methylphenylene group, a dimethylphenylene group, and an ethylphenylene group.

Of these, a phenylene group, a diphenylmethylene group, a diphenylethylene group, or a diphenylpropylene group is preferred, and a diphenylmethylene group is more preferred.

In the grease composition according to one embodiment of the present invention, a content of the component (B) is preferably 0.5% by mass or more, more preferably 0.6% by mass or more, still more preferably 0.7% by mass or more, yet still more preferably 0.8% by mass or more, and even still more preferably 1.0% by mass or more, based on the total amount (100% by mass) of the grease composition. On the other hand, the content of the component (B) is preferably 15.0% by mass or less, more preferably 13.0% by mass or less, still more preferably 10.0% by mass or less, yet still more preferably 8.0% by mass or less, and even still more preferably 6.0% by mass or less, based on the total amount (100% by mass) of the grease composition.

When the content of the component (B) is within the above range, it is easy to adjust the worked penetration of the obtained grease composition to an appropriate range.

On the other hand, in a case where the content of the component (B) is 20.0% by mass or less, the grease composition is likely to be liquefied when heated (in other words, the fluidity is likely to be further increased) and is easy to handle in a case where an operation of immersing a device and filling the device with the grease composition is performed.

<Production Method for Urea-Based Thickener (B)>

The urea-based thickener (B) can be usually obtained by reacting an isocyanate compound with a monoamine. The reaction is preferably carried out by adding a solution ß obtained by dissolving the monoamine in the base oil (A) to a heated solution α obtained by dissolving the isocyanate compound in the base oil (A).

For example, in a case of synthesizing a compound represented by the general formula (b1), a diisocyanate having a group corresponding to the divalent aromatic hydrocarbon group represented by $R^3$ in the general formula (b1) is used as the isocyanate compound, and an amine having a group corresponding to the monovalent hydrocarbon group represented by $R^1$ and $R^2$ is used as the monoamine, whereby a desired urea-based thickener (B) can be synthesized according to the method.

In order to satisfy the requirement (I) and further the requirement (II), from the viewpoint of micronizing the urea-based thickener (B) in the grease composition, it is preferred to produce the grease composition containing the component (A) and the component (B) by a grease production apparatus as expressed in the following [1].

[1] A grease production apparatus including:

a container body including an introduction portion into which a grease raw material is introduced and a discharge portion for discharging the grease into the outside; and a rotor having a rotation axis in an axial direction of an inner periphery of the container body and rotatably provided in the container body, in which the rotor includes a first concave-convex portion in which (i) concave and convex are alternately provided along a surface of the rotor, and the concave and the convex are inclined to the rotation axis, and (ii) a feeding ability from the introduction portion to a direction of the discharge portion is provided.

While the grease production apparatus in the above [1] is hereunder described, the expression "preferred" prescribed below is an embodiment from the viewpoint of micronizing the urea-based thickener (B) in the grease composition so as to satisfy the requirement (I) and further the requirement (II), unless otherwise specifically indicated.

FIG. 1 is a schematic cross-sectional view of the grease production apparatus in the above [1] that can be used in one embodiment of the present invention.

A grease production apparatus 1 shown in FIG. 1 includes a container body 2 for introducing a grease raw material into the inside thereof, and a rotor 3 having a rotation axis 12 on a central axis line of an inner periphery of the container body 2 and rotating around the rotation axis 12 as a center axis.

The rotor 3 rotates at a high speed around the rotation axis 12 as a center axis to impart a high shearing force to the grease raw material inside the container body 2. Thus, a grease containing the urea-based thickener (B) is produced.

As shown in FIG. 1, the container body 2 is preferably partitioned to an introduction portion 4, a retention portion 5, a first inner peripheral surface 6, a second inner peripheral surface 7, and a discharge portion 8 in this order from an upstream side.

As shown in FIG. 1, it is preferred that the container body 2 has an inner peripheral surface forming such a truncated cone shape that an inner diameter thereof gradually increases from the introduction portion 4 toward the discharge portion 8.

The introduction portion 4 serving as one end of the container body 2 is provided with a plurality of solution introducing pipes 4A and 4B for introducing a grease raw material from the outside of the container body 2.

The retention portion 5 is disposed in a downstream portion of the introduction portion 4, and is a space for temporarily retaining the grease raw material introduced from the introduction portion 4. When the grease raw material is retained in the retention portion 5 for a long time, the grease adhered to an inner peripheral surface of the retention portion 5 forms a large lump, so that it is preferred to transport the grease raw material to the first inner peripheral surface 6 in a downstream side in the shortest possible time. More preferably, it is preferred to transport the grease raw material directly to the first inner peripheral surface 6 without passing through the retention portion 5.

The first inner peripheral surface 6 is disposed in a downstream portion adjacent to the retention portion 5, and the second inner peripheral surface 7 is disposed in a downstream portion adjacent to the first inner peripheral surface 6. As mentioned later in detail, it is preferred to provide a first concave-convex portion 9 on the first inner peripheral surface 6 and to provide a second concave-convex portion 10 on the second inner peripheral surface 7, for the purpose of allowing the first inner peripheral surface 6 and the second inner peripheral surface 7 to function as a high shearing portion for imparting a high shearing force to the grease raw material or grease.

The discharge portion 8 serving as the other end of the container body 2 is a portion for discharging the grease stirred by the first inner peripheral surface 6 and the second inner peripheral surface 7, and is provided with a discharge port 11 for discharging the grease. The discharge port 11 is formed in a direction orthogonal or approximately orthogonal to the rotation axis 12. Accordingly, the grease is discharged from the discharge port 11 to the direction orthogonal or approximately orthogonal to the rotation axis 12. However, the discharge port 11 does not necessarily have to be orthogonal to the rotation axis 12, and may be formed in a direction parallel or approximately parallel to the rotation axis 12.

The rotor 3 is provided rotatably on a center axis line of the inner peripheral surface of the container body 2, which has a truncated cone shape, as the rotation axis 12, and rotates counterclockwise when the container body 2 is viewed from an upstream portion to a downstream portion as shown in FIG. 1.

The rotor 3 has an outer peripheral surface that expands in accordance with the enlargement of the inner diameter of the truncated cone of the container body 2, and the outer peripheral surface of the rotor 3 and the truncated cone-shaped inner peripheral surface of the container body 2 are maintained at a constant interval.

The outer peripheral surface of the rotor 3 is provided with a first concave-convex portion 13 of the rotor in which concave and convex are alternately provided along a surface of the rotor 3.

The first concave-convex portion 13 of the rotor is inclined to the rotation axis 12 of the rotor 3 in a direction from the introduction portion 4 to the discharge portion 8, and has a feeding ability in the direction from the introduction portion 4 to the discharge portion 8. That is, the first concave-convex portion 13 of the rotor is inclined in a direction in which a solution is pushed toward a downstream side when the rotor 3 rotates in the direction shown in FIG. 1.

A step difference between a concave portion 13A and a convex portion 13B in the first concave-convex portion 13 of the rotor is preferably 0.3 to 30, more preferably 0.5 to 15, and still more preferably 2 to 7, when a diameter of the concave portion 13A on the outer peripheral surface of the rotor 3 is 100.

The number of convex portions 13B in the first concave-convex portion 13 of the rotor in a circumferential direction is preferably 2 to 1,000, more preferably 6 to 500, and still more preferably 12 to 200.

A ratio of a width of the convex portion 13B to a width of the concave portion 13A in the first concave-convex portion 13 of the rotor [(width of convex portion)/(width of concave portion)] in a cross section orthogonal to the rotation axis 12 of the rotor 3 is preferably 0.01 to 100, more preferably 0.1 to 10, and still more preferably 0.5 to 2.

An inclination angle of the first concave-convex portion 13 of the rotor to the rotation axis 12 is preferably 2° to 85°, more preferably 3° to 45°, and still more preferably 5° to 20°.

It is preferred that the first inner peripheral surface 6 of the container body 2 is provided with the first concave-convex portion 9 formed with a plurality of concave and convex along the inner peripheral surface thereof.

It is preferred that the concave and the convex of the first concave-convex portion 9 on a container body 2 side are inclined in a direction opposite to the first concave-convex portion 13 of the rotor.

That is, it is preferred that the plurality of concave and convex in the first concave-convex portion 9 on the container body 2 side are inclined in the direction in which the solution is pushed toward the downstream side when the rotation axis 12 of the rotor 3 rotates in the direction shown in FIG. 1. A stirring ability and a discharge ability are further enhanced by the first concave-convex portion 9 having the plurality of concave and convex provided on the first inner peripheral surface 6 of the container body 2.

A depth of the concave and the convex in the first concave-convex portion 9 on the container body 2 side is preferably 0.2 to 30, more preferably 0.5 to 15, and still more preferably 1 to 5, when the inner diameter (diameter) of the container is set to 100.

The number of the concave and the convex in the first concave-convex portion 9 on the container body 2 side is preferably 2 to 1,000, more preferably 6 to 500, and still more preferably 12 to 200.

A ratio of a width of a concave portion to a width of a convex portion between grooves in the concave and the convex in the first concave-convex portion 9 on the container body 2 side [(width of concave portion)/(width of convex portion)] is preferably 0.01 to 100, more preferably 0.1 to 10, and still more preferably 0.5 to 2 or less.

An inclination angle of the concave and the convex in the first concave-convex portion 9 on the container body 2 side to the rotation axis 12 is preferably 2° to 85°, more preferably 3° to 45°, and still more preferably 5° to 20°.

By providing the first concave-convex portion 9 on the first inner peripheral surface 6 of the container body 2, the first inner peripheral surface 6 can function as a shearing portion for imparting a high shearing force to the grease raw material or the grease, but the first concave-convex portion 9 does not necessarily have to be provided.

It is preferred that a second concave-convex portion 14 of the rotor having concave and convex alternately provided along the surface of the rotor 3 is provided on an outer peripheral surface of a downstream portion of the first concave-convex portion 13 of the rotor.

The second concave-convex portion 14 of the rotor is inclined to the rotation axis 12 of the rotor 3, and has a feeding restraining ability to push the solution back toward the upstream side from the introduction portion 4 toward the discharge portion 8.

A step difference in the second concave-convex portion 14 of the rotor is preferably 0.3 to 30, more preferably 0.5 to 15, and still more preferably 2 to 7, when a diameter of the concave portion in the outer peripheral surface of the rotor 3 is set to 100.

The number of convex portions in the second concave-convex portion 14 of the rotor in the circumferential direction is preferably 2 to 1,000, more preferably 6 to 500, and still more preferably 12 to 200.

A ratio of a width of a convex portion to a width of a concave portion in the second concave-convex portion 14 of the rotor in a cross section orthogonal to the rotation axis of the rotor 3 [(width of the convex portion)/(width of the concave portion)] is preferably 0.01 to 100, more preferably 0.1 to 10, and still more preferably 0.5 to 2.

An inclination angle of the second concave-convex portion 14 of the rotor to the rotation axis 12 is preferably 2° to 85°, more preferably 3° to 45°, and still more preferably 5° to 20°.

It is preferred that the second inner peripheral surface 7 of the container body 2 is provided with the second concave-convex portion 10 formed with a plurality of concave and convex adjacent to a downstream portion of the concave and the convex in the first concave-convex portion 9 on the container body 2 side.

It is preferred that the plurality of concave and convex are formed on the inner peripheral surface of the container body 2, and that the concave and the convex are inclined in a direction opposite to an inclination direction of the second concave-convex portion 14 of the rotor.

That is, it is preferred that the plurality of concave and convex in the second concave-convex portion 10 on the container body 2 side are inclined in a direction in which the solution is pushed back toward the upstream side when the rotation axis 12 of the rotor 3 rotates in the direction shown in FIG. 1. A stirring ability is further enhanced by the concave and the convex in the second concave-convex portion 10 provided on the second inner peripheral surface 7 of the container body 2. In addition, the second inner peripheral surface 7 of the container body can function as a shearing portion for imparting a high shearing force to the grease raw material or the grease.

A depth of the concave portion in the second concave-convex portion 10 on the container body 2 side is preferably 0.2 to 30, more preferably 0.5 to 15, and still more preferably 1 to 5, when the inner diameter (diameter) of the container body 2 is set to 100.

The number of concave portions in the second concave-convex portion 10 on the container body 2 side is preferably 2 to 1,000, more preferably 6 to 500, and still more preferably 12 to 200.

A ratio of a width of the convex portion to a width of the concave portion of the concave and the convex in the second concave-convex portion 10 on the container body 2 side in the cross section orthogonal to the rotation axis 12 of the rotor 3 [(width of convex portion)/(width of concave portion)] is preferably 0.01 to 100, more preferably 0.1 to 10, and still more preferably 0.5 to 2.

An inclination angle of the second concave-convex portion 10 on the container body 2 side to the rotation axis 12 is preferably 2° to 85°, more preferably 3° to 45°, and still more preferably 5° to 20°.

A ratio of a length of the first concave-convex portion 9 on the container body 2 side to a length of the second concave-convex portion 10 on the container body 2 side [(length of first concave-convex portion)/(length of second concave-convex portion)] is preferably 2/1 to 20/1.

Figure 2:
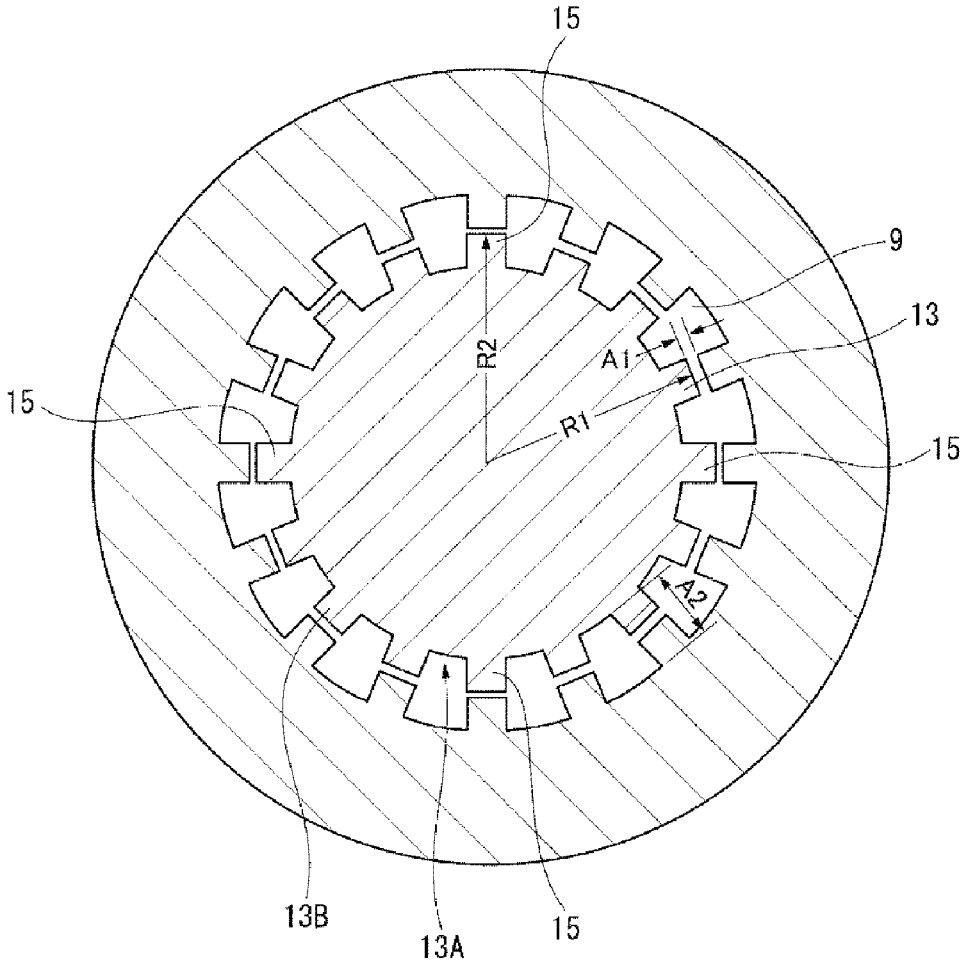
FIG. 2 is a schematic cross-sectional view in a direction orthogonal to a rotation axis in a first concave-convex portion on a container body side of the grease production apparatus in FIG. 1.

FIG. 2 is a cross-sectional view in the direction orthogonal to the rotation axis 12 in the first concave-convex portion 9 on the container body 2 side of the grease production apparatus 1.

In the first concave-convex portion 13 of the rotor shown in FIG. 2, a plurality of scrapers 15 each having a tip protruding toward an inner peripheral surface side of the container body 2 more than a tip in a protruding direction of the convex portion 13B in the first concave-convex portion 13 are provided. In addition, though not shown, the second concave-convex portion 14 is also provided with a plurality of scrapers in which a tip of the convex portion protrudes toward the inner peripheral surface side of the container body 2, similar to the first concave-convex portion 13.

The scraper 15 scrapes off the grease adhered to the inner peripheral surface of the first concave-convex portion 9 on the container body 2 side and the grease adhered to the second concave-convex portion 10 on the container body 2 side.

With respect to a protrusion amount of the tip of the scraper 15 relative to a protrusion amount of the convex portion 13B in the first concave-convex portion 13 of the rotor, a ratio [R2/R1] of a radius (R2) of the tip of the scraper 15 to a radius (R1) of the tip of the convex portion 13B is preferably more than 1.005 and less than 2.0.

The number of scrapers 15 is preferably 2 to 500, more preferably 2 to 50, and still more preferably 2 to 10.

The scraper 15 is provided in the grease production apparatus 1 shown in FIG. 1, but may not be provided, or may be provided intermittently.

In order to produce the grease containing the urea-based thickener (B) by the grease production apparatus 1, the solution α and the solution β, which are grease raw materials, are introduced respectively from the solution introducing pipes 4A and 4B in the introduction portion 4 of the container body 2, and the rotor 3 is rotated at a high speed, whereby a grease base material containing the urea-based thickener (B) can be produced.

Even by blending the hardening agent for fat and/or fatty oil (C) and an additive (D) with the thus obtained grease base material, the urea-based thickener (B) in the grease composition can be micronized so as to satisfy the requirement (I) and further the requirement (II).

As a high-speed rotation condition of the rotor 3, a shear rate imparted to the grease raw material is preferably $10^2$ $s^{-1}$ or more, more preferably $10^3$ $s^{-1}$ or more, and still more preferably $10^4$ $s^{-1}$ or more, and the shear rate is typically $10^7$ $s^{-1}$ or less.

A ratio of a maximum shear rate (Max) to a minimum shear rate (Min) in the shearing at high-speed rotation of the rotor 3 (Max/Min) is preferably 100 or less, more preferably 50 or less, and still more preferably 10 or less.

When the shear rate relative to a mixed solution is made as uniform as possible, the urea-based thickener (B) or a precursor thereof in the grease composition is readily micronized, and a more uniform grease structure is provided.

Here, the maximum shear rate (Max) is the highest shear rate imparted to the mixed solution, and the minimum shear rate (Min) is the lowest shear rate applied to the mixed solution, which are defined as follows.

Maximum shear rate (Max)=(linear velocity at tip of convex portion 13B in first concave-convex portion 13 of rotor)/(gap A1 between tip of convex portion 13B in first concave-convex portion 13 of rotor and convex portion in first concave-convex portion 9 on first inner peripheral surface 6 of container body 2)

Minimum shear rate (Min)=(linear velocity at concave portion 13A in the first concave-convex portion 13 of rotor)/(gap A2 between concave portion 13A in first concave-convex portion 13 of rotor and concave portion in first concave-convex portion 9 on first inner peripheral surface 6 of container body 2)

The gap A1 and the gap A2 are as shown in FIG. 2.

When the grease production apparatus 1 is provided with the scraper 15, the grease adhered to the inner peripheral surface of the container body 2 can be scraped off, so that the generation of the lumps during kneading can be prevented, and a grease in which the urea-based thickener (B) is micronized can be continuously produced in a short time.

When the scraper 15 scrapes off the grease adhered, it is possible to prevent the retained grease from being a resistance to rotation of the rotor 3, so that a rotational torque of the rotor 3 can be reduced, and a power consumption of a drive source can be reduced, thereby making it possible to continuously produce the grease efficiently:

Since the inner peripheral surface of the container body 2 has a truncated cone shape whose inner diameter increases from the introduction portion 4 toward the discharge portion 8, a centrifugal force has an effect of discharging the grease or the grease raw material in a downstream direction, and the rotation torque of the rotor 3 can be reduced to continuously produce the grease.

Since the first concave-convex portion 13 of the rotor is provided on the outer peripheral surface of the rotor 3, the first concave-convex portion 13 of the rotor is inclined to the rotation axis 12 of the rotor 3, the first concave-convex portion 13 has a feeding ability from the introduction portion 4 to the discharge portion 8, the second concave-convex portion 14 of the rotor is inclined to the rotation axis 12 of the rotor 3, and the second concave-convex portion 14 has a feeding suppression ability from the introduction portion 4 toward the discharge portion 8, a high shear force can be imparted to the solution, and the urea-based thickener (B) in the grease composition can be micronized so as to satisfy the requirement (I) and further the requirement (II) even after being blended with an additive.

Since the first concave-convex portion 9 is formed on the first inner peripheral surface 6 of the container body 2 and is inclined in the direction opposite to the first concave-convex portion 13 of the rotor, in addition to the effect of the first concave-convex portion 13 of the rotor, sufficient stirring for the grease raw material can be carried out while extruding the grease or the grease raw material in the downstream direction, and the urea-based thickener (B) in the grease composition can be micronized so as to satisfy the requirement (I) and further the requirement (II) even after being blended with an additive.

The second concave-convex portion 10 is provided on the second inner peripheral surface 7 of the container body 2, and the second concave-convex portion 14 of the rotor is provided on the outer peripheral surface of the rotor 3, whereby the grease raw material can be prevented from flowing out from the first inner peripheral surface 6 of the container body more than necessary. Therefore, by imparting a high shear force to the solution to highly disperse the grease raw material, the urea-based thickener (B) can be micronized so as to satisfy the requirement (I) and further the requirement (II) even after being blended with an additive.

<Hardening Agent for Fat and/or Fatty Oil (C)>

The grease composition of the present invention contains a hardening agent for fat and/or fatty oil (C) together with the component (A) and the component (B).

When the grease composition of the present invention contains the hardening agent for fat and/or fatty oil (C), the grease composition can be a grease composition which is in a solid state at ordinary temperature and liquefies when heated. Further, the filling property (adhesion property) to the apparatus can be improved.

In the present invention, the hardening agent for fat and/or fatty oil is a substance which can thicken, solidify and/or sol-gel the fatty oil at ordinary temperature by being added to and dissolved in a liquid fatty oil, and has a property of solidifying the grease composition at ordinary temperature. The term "liquefied" refers to a state in which the viscosity at 70° C. is about 5,000 mPa·s or less.

Examples of the hardening agent for fat and/or fatty oil (C) include a glycerol fatty acid ester (C1), an amino acid-based oil gelling agent (C2), an amine-based hardening agent (C3), and a sorbitol-based hardening agent (C4). These may be used alone or may be used in combination of two or more thereof.

Among these, from the viewpoints of the effects of the present invention and availability, it is preferable to use the glycerol fatty acid ester (C1).

Glycerol Fatty Acid Ester (C1)

Examples of the glycerol fatty acid ester (C1) include glycerol fatty acid ester, and polyglycerol fatty acid ester.

The polyglycerol fatty acid ester contains a fatty acid and polyglycerol as constituent components.

Regarding fatty acids constituting the polyglycerol fatty acid ester (hereinafter referred to as "constituent fatty acids"), it is preferable that linear fatty acids having 16 to 18 carbon atoms account for 45% or more of the total constituent fatty acids in terms of the number of molecules.

The polyglycerol constituting the polyglycerol fatty acid ester preferably has an average degree of polymerization of 10 or more based on the hydroxyl value. More preferably, the polyglycerol has an average degree of polymerization of 20 or more, still more preferably 30 or more, and yet still more preferably 40 or more.

The average degree of polymerization based on the hydroxyl value of polyglycerol is a value calculated by an end group analysis method. The hydroxyl value used for calculating the average degree of polymerization by the end group analysis method can be calculated in accordance with "The JOCS Standard Methods for the Analysis of Fats, Oils and Related Materials (I) 1996 edition" edited by Japan Oil Chemists' Society.

An esterification rate of the polyglycerol fatty acid ester is preferably 70% or more. The esterification rate of the polyglycerol fatty acid ester is more preferably 80% or more, and still more preferably 90% or more.

The esterification rate is a value calculated by the following equation, where the average degree of polymerization of polyglycerol calculated from the hydroxyl value by the end group analysis method is (n), the number of hydroxy groups contained in the polyglycerol is (n+2), and the number of moles of fatty acids added to the polyglycerol is (M).

$$\text{Esterification rate } (\%) = \left(M/(n+2)\right) \times 100$$

In the present invention, a polyglycerol fatty acid ester produced according to a conventional method can be used, and more specifically, a polyglycerol fatty acid ester produced by charging each of the above components in a composition satisfying the above conditions, adding a catalyst such as sodium hydroxide, and subjecting the mixture to an esterification reaction at normal pressure or under reduced pressure can be used.

In addition, in the present invention, as the polyglycerol fatty acid ester, a commercially available product may be used, and for example, TAISET AD (manufactured by Taiyo Kagaku Co., Ltd.), TAISET50 (manufactured by Taiyo Kagaku Co., Ltd.), Ryoto Polyglyester B-100D (manufactured by Mitsubishi Chemical Corporation), and the like can be suitably used.

In the grease composition of the present invention, a melting point of the hardening agent for fat and/or fatty oil (C) is preferably 50° C. or higher, and more preferably 60° C. or higher, from the viewpoint that the hardening agent for fat and/or fatty oil (C) is in a solid state at ordinary temperature and is liquefied when heated. In addition, the melting point of the hardening agent for fat and/or fatty oil (C) is higher than ordinary temperature, and to be specific, is preferably higher than ordinary temperature by 20° C. or more, and more preferably higher than ordinary temperature by 30° C. or more. The melting point of the hardening agent for fat and/or fatty oil (C) is preferably 100° C. or less, and more preferably 80° C. or less.

In the description herein, the melting point of the hardening agent for fat and/or fatty oil (C) means a value measured in accordance with JIS K 0064.

In the grease composition of the present invention, a content of the hardening agent for fat and/or fatty oil (C) is preferably 0.1 to 10.0% by mass, more preferably 0.5 to 8.0% by mass, and still more preferably 1.0 to 6.0% by mass, based on the total amount (100% by mass) of the grease composition, from the viewpoint that the hardening agent for fat and/or fatty oil (C) is in a solid state at ordinary temperature and is liquefied when heated.

A content ratio [(B)/(C)] of the urea-based thickener (B) and the hardening agent for fat and/or fatty oil (C) is preferably 0.3 to 10, more preferably 0.4 to 5, and still more preferably 0.5 to 3 in terms of mass ratio, from the viewpoint of being in a solid state at ordinary temperature, being liquefied when heated, and becoming soften when a shearing stress is applied.

<Additive (D)>

The grease composition according to one embodiment of the present invention may contain the additive (D) other than the component (B) and the component (C), which is blended in general greases, within a range in which the effects of the present invention are not impaired.

Examples of the additive (D) include an extreme pressure agent, an antioxidant, a rust inhibitor, a dispersant, and a metal deactivator.

The additive (D) may be used alone or may be used in combination of two or more thereof.

Examples of the extreme pressure agent include one or more selected from an organic metal-based extreme pressure agent, a sulfur-based extreme pressure agent, a phosphorus-based extreme pressure agent, and a sulfur-phosphorus-based extreme pressure agent.

As the organic metal-based extreme pressure agent, for example, one or more selected from organic molybdenum-based compounds such as molybdenum dialkyldithiocarbamate (MoDTC) and molybdenum dialkyldithiophosphate (MoDTP), and organic zinc-based compounds such as zinc dialkyldithiocarbamate (ZnDTC) and zinc dialkyldithiophosphate (ZnDTP) can be used.

As the sulfur-based extreme pressure agent, for example, one or more selected from sulfurized fats, sulfurized fatty oil, sulfurized fatty acids, sulfurized esters, sulfurized olefins, monosulfides, polysulfides, dihydrocarbyl polysulfides, thiadiazole compounds, alkylthiocarbamoyl compounds, thiocarbamate compounds, thioterpene compounds, and dialkyl thiodipropionate compounds can be used.

As the phosphorus-based extreme pressure agent, for example, one or more selected from phosphoric acid esters such as aryl phosphates, alkyl phosphates, alkenyl phosphates, and alkylaryl phosphates; acidic phosphoric acid esters such as monoaryl acid phosphates, diaryl acid phosphates, monoalkyl acid phosphates, dialkyl acid phosphates, monoalkenyl acid phosphates, and dialkenyl acid phosphates; phosphorous acid esters such as aryl hydrogen phosphites, alkyl hydrogen phosphites, aryl phosphites, alkyl phosphites, alkenyl phosphites, and arylalkyl phosphites; acidic phosphorous acid esters such as monoalkyl acid phosphites, dialkyl acid phosphites, monoalkenyl acid phosphites, and dialkenyl acid phosphites; and amine salts thereof can be used.

As the sulfur-phosphorus-based extreme pressure agent, for example, one or more selected from monoalkylthiophosphate, dialkyldithiophosphate, trialkyltrithiophosphate, and amine salts thereof, and zinc dialkyldithiophosphate (ZnDTP) can be used.

Examples of the antioxidant include an amine-based antioxidant such as a diphenylamine-based compound and a naphthylamine-based compound, and a phenol-based antioxidant such as a monocyclic phenol-based compound and a polycyclic phenol-based compound.

Examples of the rust inhibitor include a carboxylic acid-based rust inhibitor such as an alkenyl succinic acid polyhydric alcohol ester, zinc stearate, thiadiazole and a derivative thereof, and benzotriazole and a derivative thereof.

Examples of the dispersant include an ash-free dispersant such as succinimide and a boron-based succinimide.

Examples of the metal deactivator include a benzotriazole-based compound.

In the grease composition according to one embodiment of the present invention, a content of the additive (D) is appropriately set according to the type of the additive, but each independently is usually 0.01 to 20% by mass, preferably 0.01 to 15% by mass, more preferably 0.01 to 10% by mass, and still more preferably 0.01 to 7% by mass based on the total amount (100% by mass) of the grease composition.

<Physical Properties of Grease Composition>

(Unworked Penetration)

The unworked penetration at 25° C. of the grease composition according to one embodiment of the present invention is preferably 220 to 430, more preferably 240 to 360, still more preferably 250 to 350, and yet still more preferably 255 to 330, from the viewpoint of handling at ordinary temperature.

In the description herein, the unworked penetration of the grease composition means a value measured at 25° C. in accordance with JIS K 2220:2013 (item 7).

(Worked Penetration)

The worked penetration at 25° C. of the grease composition according to one embodiment of the present invention is preferably 220 or more, more preferably 250 or more, still more preferably 300 or more, and yet still more preferably 330 or more, and is preferably 500 or less, more preferably 450 or less, still more preferably 440 or less, and yet still more preferably 430 or less, from the viewpoint of softening when a shearing stress is applied.

In the description herein, the worked penetration of the grease composition means a value measured at 25° C. in accordance with JIS K 2220:2013 (item 7).

(Difference Between Worked Penetration and Unworked Penetration)

The difference obtained by subtracting the value of the unworked penetration from the value of the worked penetration at 25° C. of the grease composition according to one embodiment of the present invention is preferably 10 to 150, more preferably 30 to 130, still more preferably 40 to 120, and yet still more preferably 50 to 110, from the viewpoint of fluidity due to softening when a shearing stress is applied.

The larger the difference obtained by subtracting the value of the unworked penetration from the value of the worked penetration is, the more the grease composition is sheared by mixing and the softening of the grease composition is increased.

(Dropping Point)

The dropping point of the grease composition according to one embodiment of the present invention is preferably 50 to 300, more preferably 120 to 280, still more preferably 150 to 270, yet still more preferably 180 to 260, and even still more preferably 190 to 250, from the viewpoint of the fluidity of the grease.

In the description herein, the dropping point of the grease composition means a value measured in accordance with JIS K 2220:2013 (item 8).

(Solid State at Ordinary Temperature and Liquefied when Heated)

It can be confirmed that the grease composition according to one embodiment of the present invention is in a solid state at ordinary temperature and is liquefied when heated by a method described in Examples to be described later.

(Rheological Characteristics)

Regarding the grease composition according to one embodiment of the present invention, the storage elastic modulus with respect to strain is measured in a strain range of $1\times10^{-3}$% to $1\times10^{3}$% by a method described in Examples to be described later, and the absolute value of the maximum slope when the storage elastic modulus is decreased is obtained, so that the rheological characteristics (in the present invention, the property of softening by shear and becoming fluid) can be evaluated. It can be said that the larger the absolute value of the slope, the higher the responsiveness to strain (shear stress), and the more easily the grease composition is softened when shear stress is applied.

<Method for Producing Grease Composition>

The grease composition of the present invention can be produced by mixing a grease (base grease) containing the base oil (A) and the urea-based thickener (B), and the hardening agent for fat and/or fatty oil (C), and if necessary, the additive (D).

For example, the grease composition can be produced by mixing the grease (base grease) containing the base oil (A) and the urea-based thickener (B), adding and mixing the additive (D) as necessary, cooling the mixture to about 70° C. to 80° C. by natural cooling, and then blending and mixing the hardening agent for fat and/or fatty oil (C).

<Use of Grease Composition>

The grease composition of the present invention is in a solid state at ordinary temperature, liquefies when heated, and softens when shear stress is applied.

Therefore, the grease composition according to one embodiment of the present invention can be used for lubricating portions to be lubricated, such as a bearing portion, a sliding portion, a gear portion, and a joint portion, in an apparatus required to have such characteristics. More specifically, it is preferred to use the grease composition in a bearing portion of a hub unit, an electric power steering, a driving electric motor flywheel, a ball joint, a wheel bearing, a spline portion, a constant velocity joint, a clutch booster, a servo motor, a blade bearing, or a generator.

Examples of the field of apparatuses in which the grease composition of the present invention can be suitably used include the field of automobiles, the field of office equipment, the field of machine tools, the field of wind turbines, the field of construction, the field of agricultural machinery, and the field of industrial robots.

Examples of the portion to be lubricated in the apparatus for the field of automobiles, in which the grease composition according to the present invention can be suitably used, include a bearing portion in an apparatus, such as a radiator fan motor, a fan coupling, an alternator, an idler pulley, a hub unit, a water pump, a power window, a wiper, an electric power steering, an electric motor for driving with a flywheel, a ball joint, a wheel bearing, a spline portion, and a constant velocity joint; a bearing portion in an apparatus, such as a door lock, a door hinge, and a clutch booster; and a bearing portion, a gear portion, and a sliding portion in a servo motor, a blade bearing, or a generator.

Examples of the portion to be lubricated in the apparatus for the field of office equipment, in which the grease composition according to the present invention can be suitably used, include a fixing roll in an apparatus such as a printer, and bearing and gear portions in an apparatus such as a polygon motor.

Examples of the portion to be lubricated in the apparatus for the field of machine tools, in which the grease composition according to the present invention can be suitably used, include a bearing portion in a reduction gear, such as a spindle, a servo motor, and a working robot.

Examples of the portion to be lubricated in the apparatus for the field of wind turbines, in which the grease composition according to the present invention can be suitably used, include a bearing portion of a blade bearing, a generator, or the like.

Examples of the portion to be lubricated in the apparatus for the field of construction or agricultural machinery, in which the grease composition according to the present invention can be suitably used, include a bearing portion, a gear portion, and a sliding portion of a ball joint, a spline portion, or the like, Further, the present invention can be suitably used for a reduction gear provided in an industrial robot or the like, a step-up gear provided in a wind power generation facility, or the like.

Examples of the reduction gear and the step-up gear include a reduction gear composed of a gear mechanism and a step-up gear composed of a gear mechanism. However, an application object of the grease composition according to one embodiment of the present invention is not limited to the reduction gear composed of a gear mechanism and the step-up gear composed of a gear mechanism. For example, the grease composition according to one embodiment of the present invention can also be applied to a traction drive or the like. In addition, examples of the reduction gear include an RV type, a harmonic type, and a cyclo type, any of which can be suitably used.

In addition, according to one embodiment of the present invention, there is provided an apparatus having the grease composition according to the present invention in a lubricating site, such as a bearing portion, a sliding portion, a gear portion, and a joint portion, preferably a reduction gear or a step-up gear.

Further, according to one embodiment of the present invention, there is provided a lubricating method for lubricating a lubricating site in an apparatus, such as a reduction gear and a step-up gear (for example, a bearing portion, a sliding portion, a gear portion, and a joint portion) with the grease composition according to the present invention.

According to one embodiment of the present invention, the following [1] to [9] are provided.

[1] A grease composition containing a base oil (A), a urea-based thickener (B), and a hardening agent for fat and/or fatty oil (C), in which particles containing the urea-based thickener (B) in the grease composition satisfy the following requirement (I):

Requirement (I): an arithmetic average particle diameter of the particles on an area basis as measured by a laser diffraction and scattering method is 2.0 μm or less.

[2] The grease composition as set forth in [1], in which the particles containing the urea-based thickener (B) in the grease composition further satisfy the following requirement (II):

Requirement (II): a specific surface area of the particles as measured by the laser diffraction and scattering method is $0.5\times10^5$ $cm^2/cm^3$ or more.

[3] The grease composition as set forth in [1] or [2], in which a content of the hardening agent for fat and/or fatty oil (C) is 0.1% by mass to 10% by mass based on a total amount of the grease composition.

[4] The grease composition as set forth in any one of [1] to [3], in which the hardening agent for fat and/or fatty oil (C) has a melting point of 100° C. or lower.

[5] The grease composition as set forth in any one of [1] to [4], in which a content of the urea-based thickener (B) is 1.0% by mass to 20.0% by mass based on the total amount of the grease composition.

[6] The grease composition as set forth in any one of [1] to [5], in which the base oil (A) has a kinematic viscosity at 40° C. of 10 $mm^2/s$ to 80 $mm^2/s$.

[7] The grease composition as set forth in any one of [1] to [6], having a worked penetration of 300 to 500.

[8] The grease composition as set forth in any one of [1] to [7], which is used to lubricate a lubricating site in a reduction gear or a step-up gear.

[9] A lubricating method including: lubricating a lubricating site in a reduction gear or a step-up gear with the grease composition as set forth in any one of [1] to [8].

EXAMPLES

The present invention will be specifically described with reference to the following Examples, but the present invention is not limited to the following Examples.

[Various Physical Property Values]

The measurement methods of various physical property values were as follows.

(1) Kinematic Viscosity at 40° C., Kinematic Viscosity at 100° C., and Viscosity Index of Base Oil (A)

The measurement and calculation were performed in accordance with JIS K 2283:2000.

(2) Melting Point of Hardening Agent for Fat and/or Fatty Oil (C)

The measurement was performed in accordance with JIS K 0064.

(3) Unworked Penetration (1/4) of Grease Composition

The measurement was performed at 25° C. in accordance with JIS K 2220:2013 (item 7).

(4) Worked Penetration (1/4) of Grease Composition

The measurement was performed at 25° C. in accordance with JIS K 2220:2013 (item 7).

(5) Difference between Worked Penetration and Unworked Penetration of Grease Composition The difference was calculated by subtracting the numerical value of the unworked penetration of (3) from the numerical value of the worked penetration of (4).

(6) Dropping Point of Grease Composition

The measurement was performed in accordance with JIS K 2220:2013 (item 8).

[Raw Materials]

In Examples 1 and 2 and Comparative Examples 1 to 4, the base oil (A) and the hardening agent for fat and/or fatty oil (C), which were used as raw materials for preparing the grease composition, were as follows.

<Base Oil (A)>

Base oil (A1): base oil classified into Group III in the API classification (kinematic viscosity at 40° C.: 19 $mm^2/s$, kinematic viscosity at 100° C.: 4.2 $mm^2/s$, and viscosity index: 126)

Base oil (A2): bright stock (kinematic viscosity at 40° C.: 409 $mm^2/s$, kinematic viscosity at 100° C.: 30.9 $mm^2/s$, and viscosity index: 107)

<Hardening Agent for Fat and/or Fatty Oil (C)>

Glycerol fatty acid ester (C1): glycerol fatty acid ester (trade name: TAISET AD, manufactured by Taiyo Kagaku Co., Ltd., melting point: 60° C.)

Example 1

(1) Synthesis of Urea Grease 2.47 parts by mass of diphenylmethane-4,4'-diisocyanate (MDI) was added to 48.00 parts by mass of the base oil (A), which was a mixed base oil of the base oil (A1) and the base oil (A2) and was heated to 70° C., to prepare a solution α.

Separately, 1.51 parts by mass of cyclohexylamine and 1.03 parts by mass of octadecylamine (stearylamine) were added to 47.00 parts by mass of the base oil (A), which was a mixed base oil of the base oil (A1) and the base oil (A2) and was heated to 70° C., to prepare a solution β.

Then, using the grease production apparatus 1 shown in FIG. 1, equal amounts of the solution α heated to 70° C. from the solution introducing pipe 4A and the solution ß heated to 70° C. from the solution introducing pipe 4B were simultaneously introduced into the container body 2, and the solution α and the solution ß were continuously introduced into the container body 2 while the rotor 3 was rotated. Thereafter, the temperature of this mixture was raised to 160° C. with a stirring apparatus shown in FIG. 3, and the mixture was stirred for 1 hour and then subjected to a roll-mill treatment to be homogenized, thereby synthesizing a urea grease (b1).

The rotation speed of the rotor 3 of the grease production apparatus 1 used was set to 8,000 rpm. At this time, the stirring was performed with the maximum shear rate (Max) being 10,500 $s^{-1}$ and the ratio [Max/Min] of the maximum shear rate (Max) to the minimum shear rate (Min) being 3.5.

The urea-based thickener (B1) contained in the obtained urea grease (b1) corresponds to a compound in which $R^1$ and $R^2$ in the general formula (b1) are a cyclohexyl group or an octadecyl group (a stearyl group) and $R^3$ is a diphenylmethylene group.

The molar ratio of cyclohexylamine to octadecylamine (cyclohexylamine/octadecylamine) used as raw materials was 80/20.

(2) Preparation of Grease Composition

In the above (1), the urea grease (b1) discharged from the grease production apparatus 1 shown in FIG. 1 was stirred and then cooled to 70° C. by natural cooling.

Then, to the urea grease (b1) cooled to 70° C. by natural cooling, glycerol fatty acid ester (C1) was added in a blending amount shown in Table 1 and mixed to obtain a grease composition of Example 1.

Example 2 and Comparative Example 1

Grease compositions of Example 2 and Comparative Example 1 were obtained in the same manner as the grease composition of Example 1 except that the blending amount was changed as shown in Table 1.

Comparative Example 2

(1) Synthesis of Urea Grease 2.47 parts by mass of diphenylmethane-4,4'-diisocyanate (MDI) was added to 48.00 parts by mass of the base oil (A), which was a mixed base oil of the base oil (A1) and the base oil (A2) and was heated to 70° C., to prepare a solution α.

Separately, 1.51 parts by mass of cyclohexylamine and 1.03 parts by mass of octadecylamine (stearylamine) were added to 47.00 parts by mass of the base oil (A), which was a mixed base oil of the base oil (A1) and the base oil (A2) and was heated to 70° C., to prepare a solution β.

Figure 3:
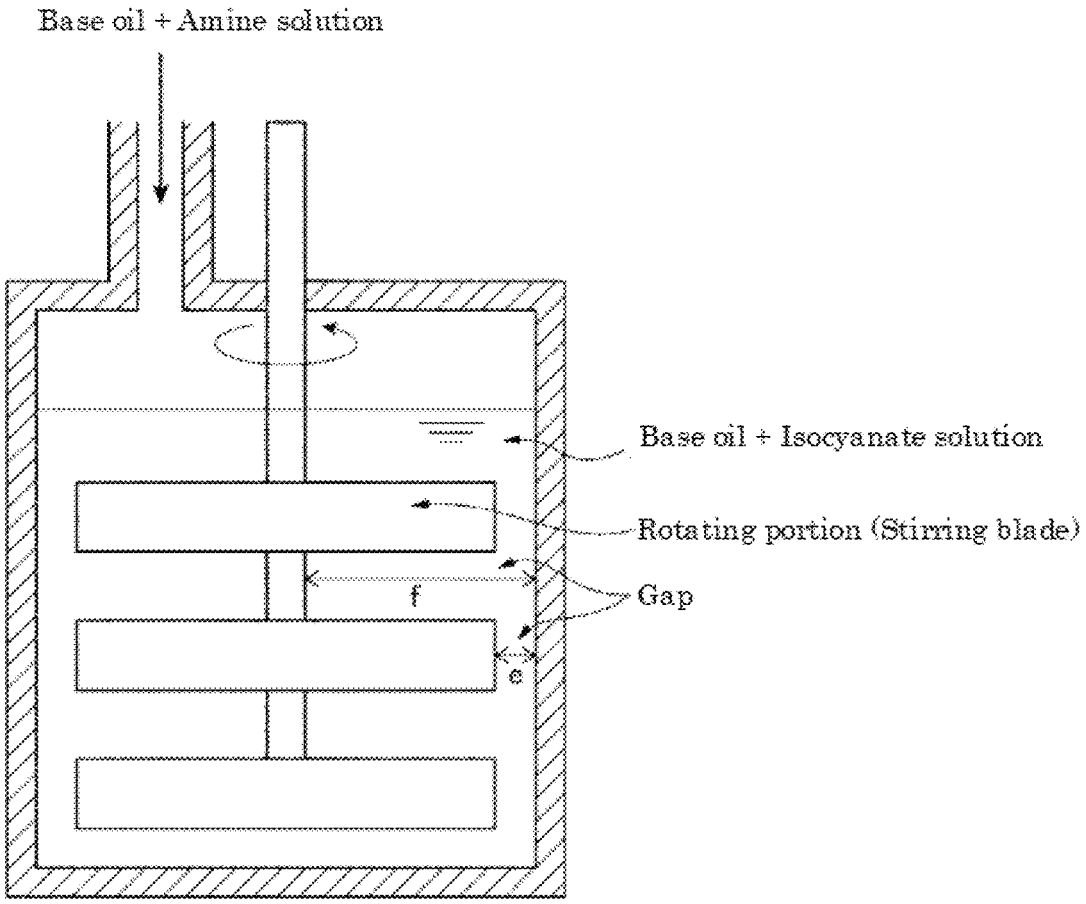
FIG. 3 is a schematic cross-sectional view of a grease production apparatus used in Comparative Example 2.

Then, using the grease production apparatus 1 shown in FIG. 3, the solution β heated to 70° C. was introduced into the solution α heated to 70° C., the stirring blade was rotated, the temperature was raised to 160° C. while continuing stirring, and the mixture was held for 1 hour to synthesize a urea grease (b2).

At this time, the maximum shear rate (Max) was about 100 $s^{-1}$, the minimum shear rate was 1.23 $s^{-1}$. In addition, the ratio (Max/Min) of the maximum shear rate (Max) and the minimum shear rate (Min) was about 81.

The urea-based thickener (B2) contained in the urea grease (b2) corresponds to a compound in which $R^1$ and $R^2$ in the general formula (b1) are a cyclohexyl group or an octadecyl group (a stearyl group) and $R^3$ is a diphenylmethylene group.

The molar ratio of cyclohexylamine to octadecylamine (cyclohexylamine/octadecylamine) used as raw materials was 80/20.

(2) Preparation of Grease Composition

In the above (1), the urea grease (b2) discharged from the grease production apparatus 1 shown in FIG. 3 was stirred and then cooled to 70° C. by natural cooling.

Then, to the urea grease (b2) cooled to 70° C. by natural cooling, glycerol fatty acid ester (C1) was added in a blending amount shown in Table 1 and mixed to obtain a grease composition of Comparative Example 2.

Comparative Examples 3 and 4

Grease compositions of Comparative Examples 3 and 4 were obtained in the same manner as the grease composition of Comparative Example 2 except that the blending amount was changed as shown in Table 1.

[Requirements]

The urea greases synthesized in Examples 1 to 2 and Comparative Examples 1 and 4 were subjected to the following calculation.

(1) Calculation of Particle Diameter of Particles Containing Urea-Based Thickener: Requirement (I)

A particle diameter of the particles containing the urea-based thickener in the grease composition was evaluated. Specifically, the urea grease as synthesized in Example 1 and the urea grease as synthesized in Comparative Example 1 were each used as a measurement sample and determined for the particle diameter of the particles, including the particle diameter of the particles containing the urea-based thickener (B), by the following procedures.

First, the measurement sample was defoamed in vacuum and then filled in a 1-mL syringe, 0.10 mL to 0.15 mL of the sample was extruded from the syringe, and the extruded sample was placed on a surface of a platy cell of a fixture for paste cell. Then, another platy cell was superimposed on the sample, thereby obtaining a measurement cell having the sample sandwiched by the two cells. Then, using a laser diffraction type particle diameter analyzer (trade name: LA-920 manufactured by Horiba, Ltd.), an arithmetic average particle diameter on an area basis of the particles in the sample of the measurement cell was measured.

Here, the "arithmetic average particle diameter on an area basis" means a value obtained by arithmetically averaging a particle diameter distribution on an area basis. The particle diameter distribution on an area basis is one expressing a frequency distribution of particle diameters in all particles as measurement targets on the basis of an area calculated based on the particle diameter (in detail, a cross-sectional area of particles having the particle diameter). In addition, the value obtained by arithmetically averaging the particle diameter distribution on an area basis can be calculated according to the following equation (1).

[Math. 1]

$$\text{Arithmetic average particle diameter} = \sum\{q(J) \times X(J)\} \div \sum\{q(J)\} \quad (1)$$

In the equation (1), J means a division number of particle diameter, q(J) means a frequency distribution value (unit: %), and X(J) means a representative diameter (unit: μm) in a range of a J-th particle diameter.

(2) Calculation of Specific Surface Area of Particles Containing Urea-Based Thickener: Requirement (II)

The specific surface area was calculated using the particle diameter distribution of the particles containing the thickener in the grease composition as measured in the section of Requirement (I). Specifically, using the particle diameter distribution, the total of surface areas (unit: $cm^2$) of particles per unit volume (1 $cm^3$) was calculated, and was designated as the specific surface area (unit: $cm^2/cm^3$).

The composition and physical property values of the grease composition are shown in Table 1.

TABLE 1

| Constituent component (unit) | | | | Example 1 | Example 2 | Comparative Example 1 | Comparative Example 2 | Comparative Example 3 | Comparative Example 4 |
|---|---|---|---|---|---|---|---|---|---|
| Grease composition | Base oil (A) | Base oil (A1) | % by mass | 66.0 | 66.0 | 66.0 | 66.0 | 66.0 | 66.0 |
| | | Base oil (A2) | % by mass | 25.0 | 27.0 | 30.0 | 25.0 | 27.0 | 30.0 |
| | Urea-based thickener (B) | Urea-based thickener (B1) | % by mass | 4.0 | 4.0 | 4.0 | — | — | — |
| | | Urea-based thickener (B2) | % by mass | — | — | — | 4.0 | 4.0 | 4.0 |
| | Hardening agent for fat and/or fatty oil (C) | Glycerol fatty acid ester (C1) | % by mass | 5.0 | 3.0 | — | 5.0 | 3.0 | — |
| | Total | | % by mass | 100.0 | 100.0 | 100.0 | 100.0 | 100.0 | 100.0 |
| Physical property value | Base oil (A) | Kinematic viscosity at 40° C. | $mm^2/s$ | 62 | 68 | 72 | 62 | 68 | 72 |
| | | Viscosity index | — | 152 | 150 | 145 | 152 | 150 | 145 |
| | Urea-based thickener (B) | Arithmetic average particle diameter of particles | μm | 0.5 | 0.5 | 0.3 | 10.0 | 10.0 | 10.0 |
| | | Specific surface area of particles | $cm^2/cm^3$ | $5.0 \times 10^4$ | $1.5 \times 10^5$ | $2.0 \times 10^5$ | $6.0 \times 10^3$ | $6.0 \times 10^3$ | $6.0 \times 10^3$ |
| | Grease composition | Unworked penetration (1/4) | — | 261 | 310 | 378 | 272 | 296 | 375 |
| | | Worked penetration (1/4) | — | 360 | 373 | 384 | 311 | 324 | 387 |
| | | Difference between worked penetration and unworked penetration | — | 99 | 63 | 6 | 39 | 28 | 12 |
| | | Dropping point | ° C. | 235 | 237 | 238 | 243 | 247 | 241 |

The grease compositions obtained in Examples 1 and 2 and the grease compositions obtained in Comparative Examples 1 to 4 were subjected to the following tests in order to confirm that they were in a solid state at ordinary temperature and liquefied when heated.

[Confirmation of Solid State at Ordinary Temperature and Liquefied when Heated]

The grease composition of Example 1 was heated to 70° C. at room temperature to liquefy the grease composition. A bearing was placed therein, and the filling state of the grease composition in the gap of the bearing was visually checked. In addition, the filling state after returning to room temperature was visually checked, and the retainability of the grease composition was checked by reversing the bearing so that the open surface of the bearing was downward and determining the presence or absence of dripping.

Further, also in Comparative Example 1, the filling state into the gap of the bearing, the filling state after returning to room temperature, and the retainability of the grease composition were checked in the same manner as in Example 1.

As a result of this test, it was confirmed that the grease composition of Example 1 was in a solid state at room temperature and liquefied when heated to 70° C., and the grease composition was easily filled in the gaps of the bearings. In addition, after returning to room temperature, the grease composition was solidified, and the grease composition was sufficiently held in the gaps of the bearings.

On the other hand, in the grease composition of Comparative Example 1 not containing the hardening agent for fat and/or fatty oil (C), the grease composition was liquefied even after the grease composition was heated to 70° C. and then returned to room temperature, the gaps of the bearings were not filled with the grease composition, and dripping from the bearings was observed. That is, in the grease composition of Comparative Example 1 not containing the hardening agent for fat and/or fatty oil (C), the grease composition did not return to a solid state after the grease composition was heated to 70° C. and then returned to room temperature, and thus the capability of the grease composition was not exhibited.

Next, the rheological characteristics of Examples 1 and 2 and Comparative Examples 1 to 4 were evaluated.

[Evaluation of Rheological Characteristics]

The storage elastic modulus in a strain range of $1\times10^{-3}$% to $1\times10^{3}$% was measured at room temperature (25° C.) using an apparatus name: Anton-Paar MCR302.

In addition, the storage elastic modulus was plotted with respect to the strain, and the maximum slope (negative number) when the storage elastic modulus decreased was compared.

Figure 4:
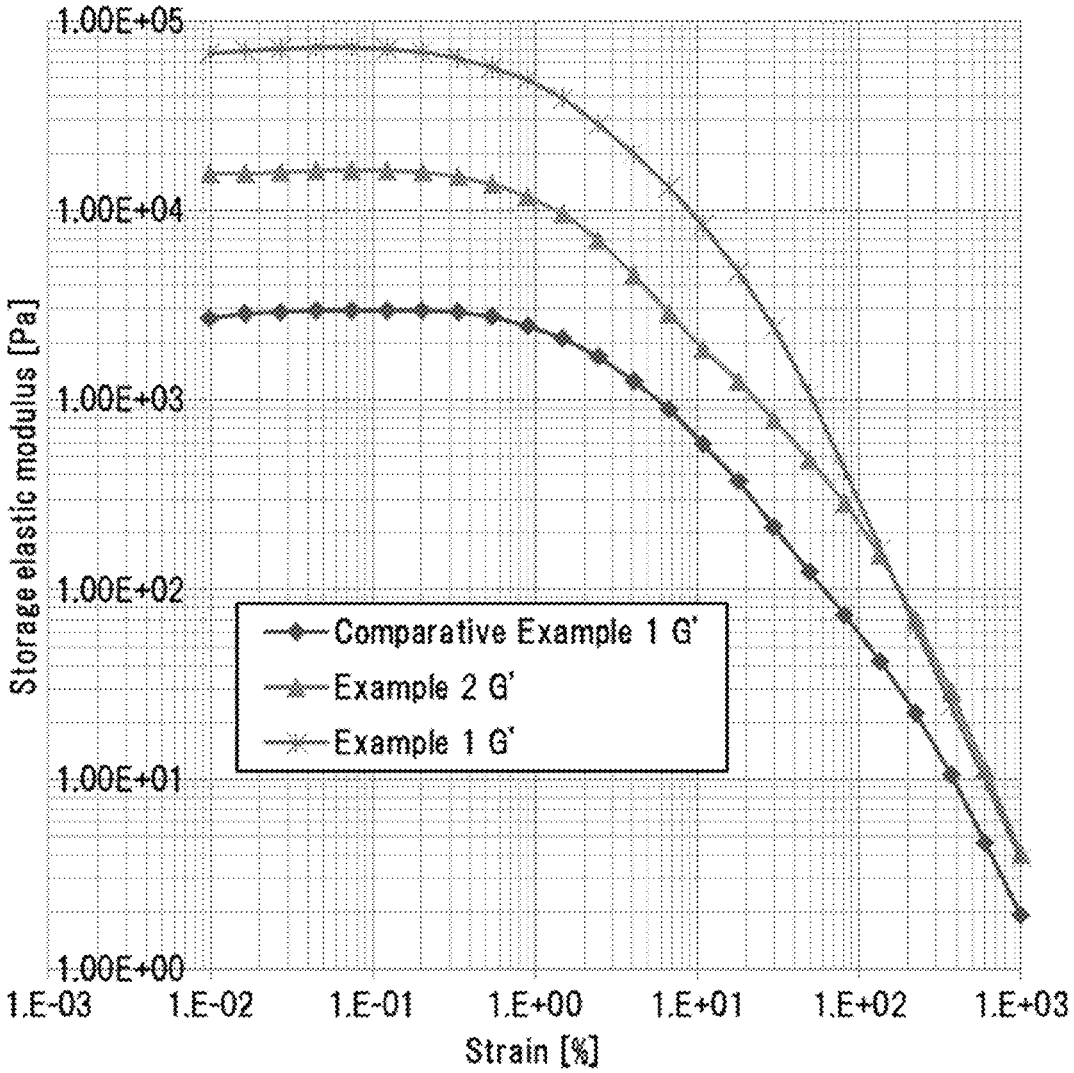
FIG. 4 shows rheometer measurement results of Examples 1 and 2 and Comparative Example 1.
Figure 5:
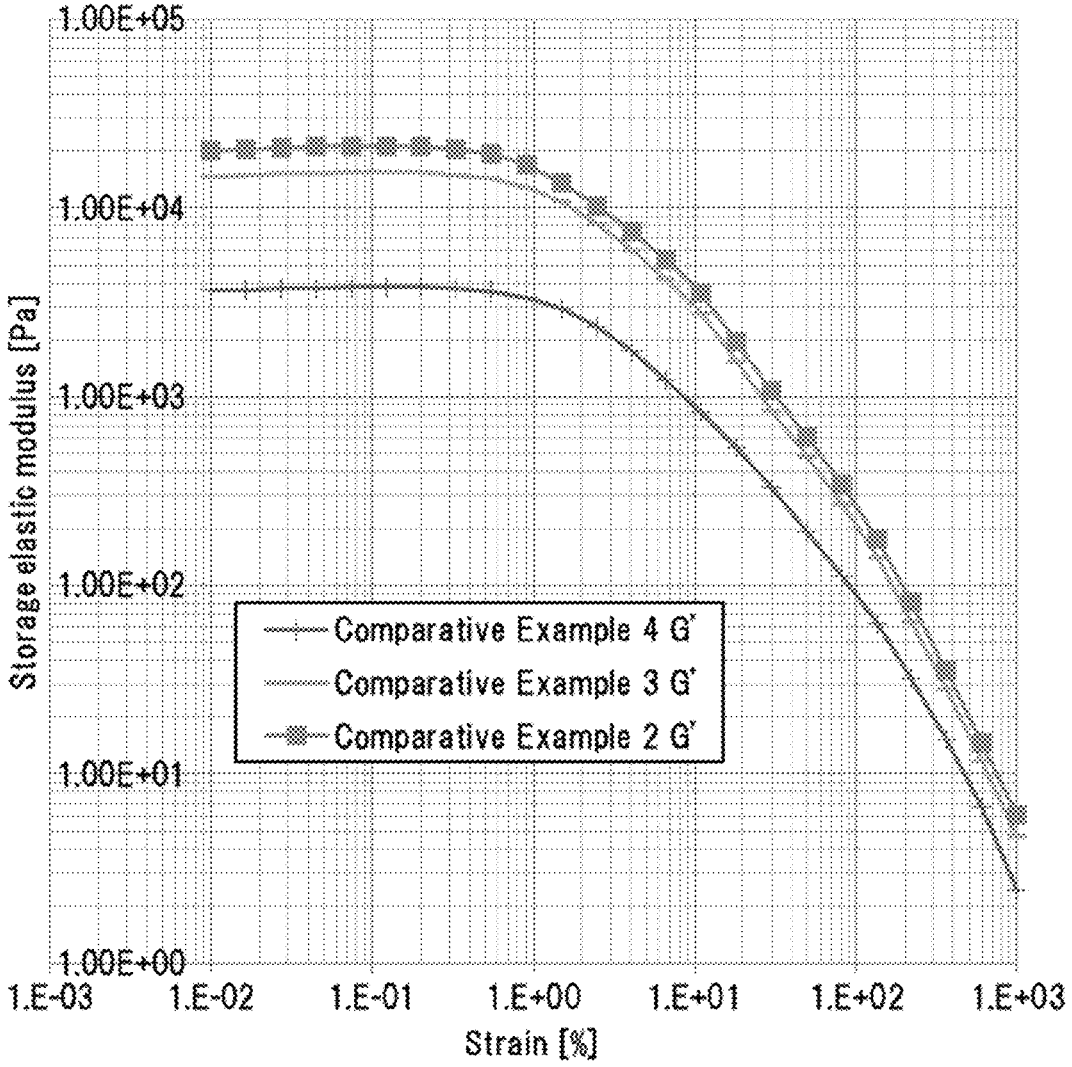
FIG. 5 shows rheometer measurement results of Comparative Examples 2 to 4.

The rheometer measurement results of Examples 1 and 2 and Comparative Example 1 are shown in FIG. 4. The rheometer measurement results of Comparative Examples 2 to 4 are shown in FIG. 5.

In the rheology curves (change in storage elastic modulus with respect to strain) of Examples 1 and 2, the maximum slope (negative number) at the time of a decrease in the storage elastic modulus was larger than that in the rheology curves of Comparative Examples 1 to 4. That is, it was found that the degree of decrease in the storage elastic modulus with respect to strain (responsiveness to decrease) was high and the storage elastic modulus was likely to become fluid with strain. From this result, it was found that the urea-based thickener (B) satisfying the requirement (I) has high responsiveness to the application of shear stress and is likely to be softened.

From the results shown in Comparative Example 1, it became clear that the urea grease not containing the hardening agent for fat and/or fatty oil (C) could be liquefied by heating, but did not return to a solid state even when returned to ordinary temperature. However, the grease compositions of Examples 1 and 2 could be liquefied by heating, and became a solid state when returned to ordinary temperature. From this, it can be said that the grease composition containing the urea-based thickener (B) and the hardening agent for fat and/or fatty oil (C) is a grease composition in which the urea-based thickener (B) does not inhibit the characteristics exhibited by the hardening agent for fat and/or fatty oil (C) (the characteristics of being able to be liquefied by heating and becoming a solid state when returned to ordinary temperature) and which has excellent rheological characteristics (high responsiveness to the application of shear stress and being easily softened).

REFERENCE SIGNS LIST

1: Grease production apparatus
2: Container body
3: Rotor
4: Introduction portion
4A, 4B: Solution introducing pipe
5: Retention portion
6: First concave-convex portion
7: Second concave-convex portion
8: Discharge portion
9: First concave-convex portion on container body side
10: Second concave-convex portion on container body side
11: Discharge port
12: Rotation axis
13: First concave-convex portion of rotor
13A: Concave portion
13B: Convex portion
14: Second concave-convex portion of rotor
15: Scraper
A1, A2: Gap

The invention claimed is:

1. A grease composition, comprising:
a base oil;
a urea-based thickener; and
a hardening agent for fat and/or fatty oil,
wherein
the hardening agent for fat and/or fatty oil is a glycerol fatty acid ester,
the urea-based thickener is contained in particles such that an arithmetic average particle diameter of the particles on an area basis as measured by a laser diffraction and scattering method is 2.0 μm or less,
the grease composition has a worked penetration in a range of 360 to 500, and
a melting point of the glycerol fatty acid ester is from 50° C. to 80° C.

2. The grease composition according to claim 1, wherein the particles comprising the urea-based thickener have a specific surface area of $0.5\times10^{5}$ $cm^2/cm^3$ or more as measured by a laser diffraction and scattering method.

3. The grease composition according to claim 1, wherein a content of the hardening agent for fat and/or fatty oil is in a range of 0.1% by mass to 10% by mass based on a total amount of the grease composition.

4. The grease composition according to claim 1, wherein a content of the urea-based thickener is in a range of 1.0% by mass to 15.0% by mass based on the total amount of the grease composition.

5. The grease composition according to claim 1, wherein the base oil has a kinematic viscosity at 40° C. in a range of 10 $mm^2/s$ to 80 $mm^2/s$.

6. The grease composition according to claim 1, wherein the grease composition has a worked penetration in a range of 360 to 450.

7. A lubricating method, comprising:

lubricating a lubricating site in a reduction gear or a step-up gear with the grease composition of claim 1.

8. The grease composition according to claim 2, wherein a content of the hardening agent for fat and/or fatty oil is in a range of 0.1% by mass to 10% by mass based on a total amount of the grease composition.

9. The grease composition according to claim 2, wherein a content of the urea-based thickener is in a range of 1.0% by mass to 15.0% by mass based on the total amount of the grease composition.

10. The grease composition according to claim 2, wherein the base oil has a kinematic viscosity at 40° C. in a range of 10 $mm^2/s$ to 80 $mm^2/s$.

11. The grease composition according to claim 2, wherein the grease composition has a worked penetration in a range of 360 to 450.

12. A lubricating method, comprising:

lubricating a lubricating site in a reduction gear or a step-up gear with the grease composition of claim 2.

13. The grease composition according to claim 3, wherein a content of the urea-based thickener is in a range of 1.0% by mass to 15.0% by mass based on the total amount of the grease composition.

14. The grease composition according to claim 3, wherein the base oil has a kinematic viscosity at 40° C. in a range of 10 $mm^2/s$ to 80 $mm^2/s$.

15. The grease composition according to claim 3, wherein the grease composition has a worked penetration in a range of 360 to 450.

16. A lubricating method, comprising:

lubricating a lubricating site in a reduction gear or a step-up gear with the grease composition of claim 3.

17. A method for filling a grease composition according to claim 1, comprising:

heating the grease composition from a solid state to a temperature to liquefy the composition;

immersing a device in the liquefied grease composition to fill gaps of the device with the liquefied grease composition;

removing the device containing the grease composition filled gaps from the liquefied grease composition;

returning the device containing the grease composition filled gaps to ordinary temperature, and returning the grease composition to a solid state temperature.

* * * * *